US007108393B2

(12) United States Patent
Kleewein et al.

(10) Patent No.: US 7,108,393 B2
(45) Date of Patent: Sep. 19, 2006

(54) LIGHTING SYSTEM FOR A MOVING WALKWAY OR ESCALATOR INSTALLATION, AND MOVING WALKWAY OR ESCALATOR INSTALLATION WITH LIGHTING SYSTEM

(75) Inventors: Gerhard Kleewein, Pressbaum (AT); Gerald Winkler, Neusiedl am See (AT)

(73) Assignee: Inventio AG, Hergiswil (CH)

( * ) Notice: Subject to any disclaimer, the term of this patent is extended or adjusted under 35 U.S.C. 154(b) by 71 days.

(21) Appl. No.: 10/862,651

(22) Filed: Jun. 7, 2004

(65) Prior Publication Data

US 2004/0257800 A1 Dec. 23, 2004

(30) Foreign Application Priority Data

Jun. 17, 2003 (EP) ..... 03405434

(51) Int. Cl.
*F21S 8/00* (2006.01)

(52) U.S. Cl. ..... 362/146; 362/145

(58) Field of Classification Search ..... 362/145, 362/146

See application file for complete search history.

(56) References Cited

U.S. PATENT DOCUMENTS 4,367,517 A * 1/1983 Balzer ..... 362/146
4,756,398 A * 7/1988 Watanabe et al. ..... 198/324
4,896,759 A * 1/1990 Badstuebner et al. ..... 198/324
5,067,062 A * 11/1991 Rulke ..... 362/146
5,099,402 A * 3/1992 Starniri ..... 362/146
6,129,442 A * 10/2000 Hoefling et al. ..... 362/146
6,866,125 B1 * 3/2005 Ball et al. ..... 187/391

FOREIGN PATENT DOCUMENTS

| | | |
|---|---|---|
| CH | 393702 | 11/1965 |
| DE | 297 12 530 U1 | 9/1997 |
| DE | 298 15 363 U1 | 1/2000 |
| EP | 1 081 087 A1 | 3/2001 |
| JP | 64-75394 A | 3/1989 |
| JP | 07 144 865 A | 6/1995 |
| JP | 09 286 635 A | 4/1997 |
| JP | 11 255 458 A | 9/1999 |
| JP | 11 292 445 A | 10/1999 |

* cited by examiner

*Primary Examiner*—Thomas M. Simbo
*Assistant Examiner*—Adam C. Rehm
(74) *Attorney, Agent, or Firm*—Schweitzer Cornman Gross & Bondell LLP

(57) ABSTRACT

A lighting system for a moving walkway or escalator installation and a moving walkway or escalator installation with a lighting system is disclosed. The moving walkway or escalator installation comprises a plate belt or step belt and a balustrade. The lighting system comprises a light-permeable inner panelling of the balustrade which is formed by one or more mutually adjoining plates free of interruption as well as one or more lighting bodies which are mounted in corresponding sockets. The sockets are fastened in the interior of the balustrade to a mechanical structure. The inner panelling of the balustrade can be illuminated over a whole area by the lighting system.

11 Claims, 3 Drawing Sheets

LIGHTING SYSTEM FOR A MOVING WALKWAY OR ESCALATOR INSTALLATION, AND MOVING WALKWAY OR ESCALATOR INSTALLATION WITH LIGHTING SYSTEM

The invention relates to a lighting system for a moving walkway or escalator installation, which comprises a plate belt or step belt and a lateral balustrade.

BACKGROUND OF THE INVENTION

Moving walkway and escalator installations are used virtually exclusively in the public domain, particularly in the realm of public traffic, for example in railway stations, underground railway stations, in warehouses, shopping centres as well as in larger hotels. They usually comprise a plate belt or step belt which is movable in the longitudinal direction thereof and stationary lateral balustrades, which frequently consist of metal plates (sheet-metal plates), these being fastened to balustrade uprights. Arranged above each balustrade is a handrail moving with the plate belt or step belt.

In order to increase comfort for users and to avoid accidents it is important that good lighting conditions prevail in the region of the moving walkway and escalator installations. For this purpose, newer moving walkway and escalator installations generally have their own lighting systems.

Known lighting systems for moving walkway and escalator installations are so designed that only certain regions of the moving walkway or escalator installations are illuminated. These regions are disposed between the balustrades, which usually consist of metal plates (sheet-metal plates). What may be lit, for example, is usually an upper region with the handrail, a lower region in which the balustrades and the plate belt or step belt meet, or those regions in which the moving walkway or escalator installations are entered or left. However, moving walkway and escalator installations cannot be lit by such lighting systems in a manner that a high level of use comfort and safe accident prevention are achieved.

In order to better illuminate the space between the balustrades there have also been produced balustrades, the inner panelling—which faces the plate belt or step belt—of which has interruptions. Lighting bodies can be arranged in the interruptions or behind the inner panelling. A somewhat better illumination of the space between the balustrades can indeed be achieved by such a lighting system, but the inner panelling of the balustrade is not stable due to the interruptions formed therein or, in order to have a sufficient stability notwithstanding the interruptions, it has to be constructed to be very solid. Moreover, balustrades with interruptions are exposed to vandalism. A further disadvantage resides in the fact that the lighting system has to be mounted very precisely, whereby the mounting and, in a given case, the replacement of defective lighting bodies, are expensive. Furthermore, cleaning of the inner panelling of the balustrade is complicated or inconvenient due to the interruptions.

It is thus the object of the invention to provide a lighting system for moving walkway and escalator installations as well as a well-lit moving walkway or escalator installation in which the disadvantages of conventional lighting systems are avoided. In particular, the new lighting system allows particularly good illumination of the space between the balustrades and is able to be realised by a light, but nevertheless rigid inner panelling of the balustrades. In such a case, a novel optical effect can be achieved which not only has an aesthetic appeal, but due to the uninterrupted and continuous lit area also increases safety on the moving escalator. The new lighting system is able to be easily cleaned and is as secure against vandalism as possible. Moreover, assembly and maintenance is able to be managed in simple manner.

BRIEF DESCRIPTION OF THE INVENTION

The new and inventive lighting system, which has been developed for a moving walkway or escalator installation, comprises a balustrade at at least one side of the plate belt or step belt, and which has an inner panelling and an outer panelling and which is closed off at the top. The inner panelling is formed to be permeable to light and free of interruption. One or more lighting bodies are disposed at the side of the inner panelling which is remote from the plate belt or step belt, i.e. in the interior of the balustrade. The lighting bodies emit light which impinges on the inner panelling over the whole area and passes through the light-permeable inner panelling into the space between the balustrades, which are disposed to the right and the left of the moving walkway or the escalator. The inner panelling of the balustrade is formed by a plate or several closely mutually adjoining plates. These plates form, when the lighting bodies are in operation, illuminated panels. The lighting bodies are arranged in corresponding sockets. The sockets are fastened to a mechanical structure within the balustrade.

Due to the illumination up of the inner panelling of each balustrade over the whole area the space between the balustrades, which are disposed to the right and left of the moving walkway or the escalator, is lit up entirely uniformly.

The plates which form the inner panelling of the balustrade do not have any interruptions intended for the passage of light or for the fastening of lighting bodies. The plates are therefore rigid even when they are not particularly solid.

Further advantages of the new lighting system are to be seen in the fact that the inner panelling, due to the absence of interruptions, is simple to clean and very secure against vandalism and that a highly precise mounting of the lighting bodies or their sockets and their current supply is not required.

So that no additional mechanical structure is required for fastening the lighting bodies, it is advantageous to use the balustrade uprights, which are present in any case, as a structure for the mounting of the lighting bodies. The sockets of the lighting bodies can be mounted by means of suitable fastening aids, for example by means of fastening brackets.

It has proved advantageous to make the light-permeable and interruption-free inner panelling of the balustrade from a laminated safety glass, called LSG for short. Such a laminated safety glass can comprise two or more layers.

It is particularly advantageous to construct the light-permeable inner panelling so that it is dazzle-free. For this purpose it can be constructed like opal glass and/or colour-tinted. An opal glass or tinting effect can be achieved by an appropriate film arranged between mutually adjacent layers or at the surface, which faces the lighting bodies of the safety laminated glass.

It is also particularly advantageous to provide a coating of a fluorescing material on the inner panelling on the surface facing the lighting bodies.

In addition, a safety laminated glass with a slightly structured, for example corrugated or waved, surface can be used. Structured inner panellings have, inter alia, the advantage that small amounts of damage are less visible and optical effects are more easy to manage.

Conventional tubes, such as neon tubes or power-saving lighting bodies, can be used as lighting bodies. Several types of lighting bodies can also be used in combination, for example incandescent lamps, LEI, electroluminescent or electrophosphorescent. The lighting bodies can also be constructed so that they emit color-toned light.

In order to obtain faultless illumination of the inner panelling over the whole area it is advantageous to provide the lighting bodies with suitable reflectors.

In general, only the inner panellings of the balustrades, i.e. the surfaces of the balustrades facing the plate belt or step belt, have to be made permeable to light as described above, while the outer panellings of the balustrades can be made, as usual, from metal plates. In certain cases, however, it can also be desirable to construct the outer panellings of the balustrades to be permeable to light. It is thus possible to produce, for example in a hotel lobby, a form of warning illumination at the escalator installation in order to avoid accidental collision of persons with the part of the escalator installation lying at body height, i.e. below about 2 metres. Moreover, an additional general room lighting is obtained.

BRIEF DESCRIPTION OF THE DRAWINGS

Further details and advantages of the invention are described in the following on the basis of preferred examples of embodiment and with reference to the annexed drawings, in which.

DETAILED DESCRIPTION OF THE INVENTION

Figure 1:
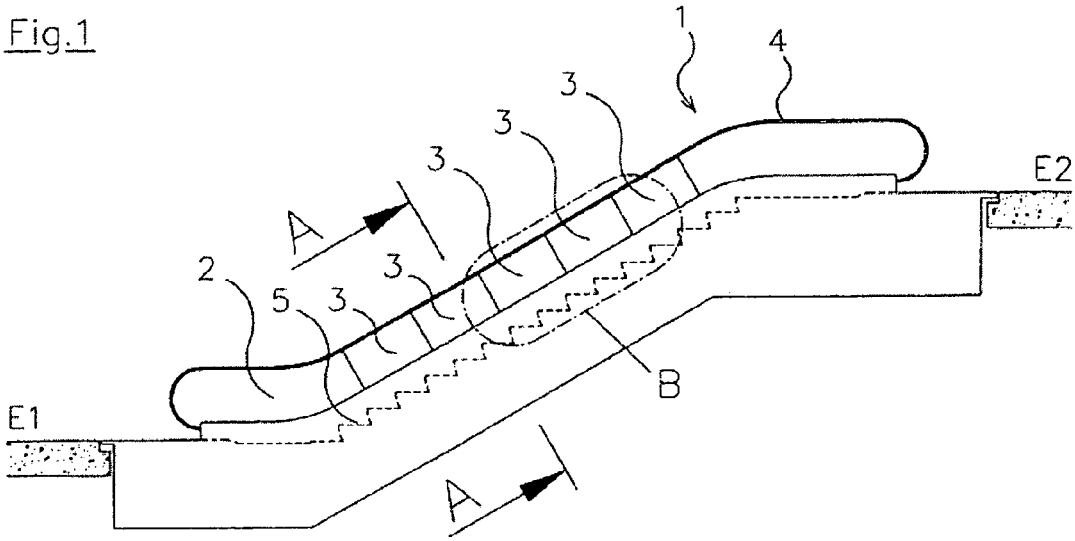
FIG. 1 shows an escalator with a lighting system according to the invention, in a side view.
Figure 2:
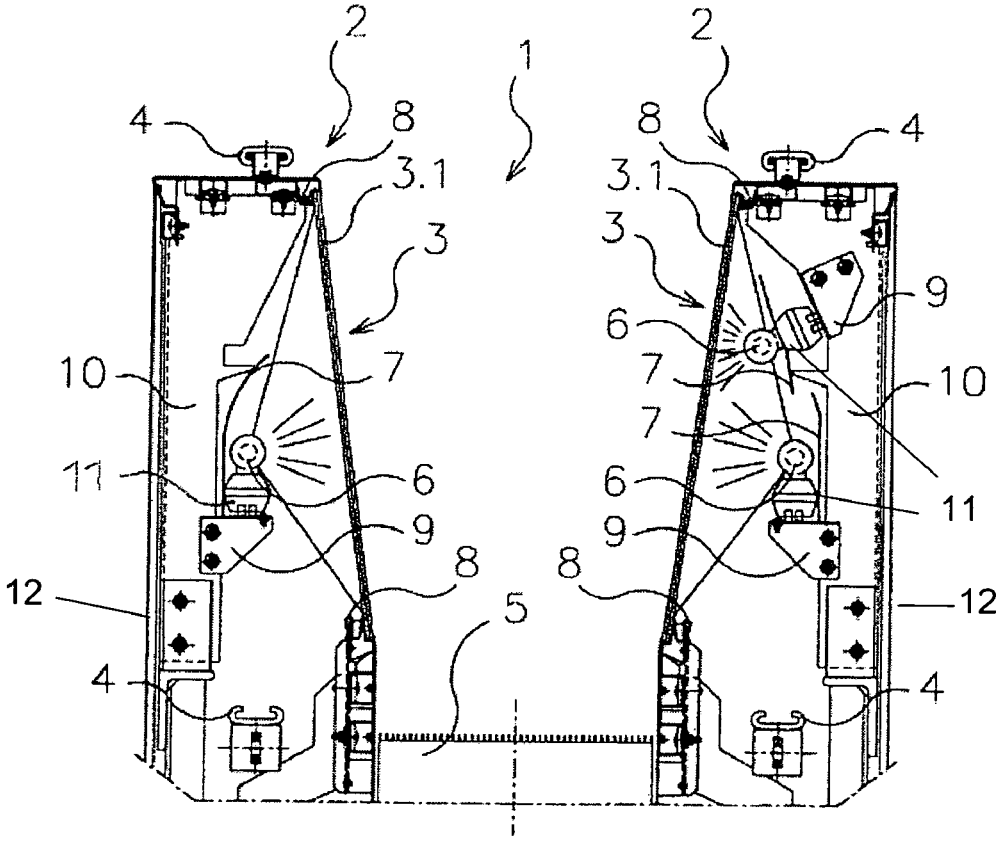
FIG. 2 shows the escalator illustrated in FIG. 1, in section, along the line A—A of FIG. 1, wherein the lefthand half of the drawing presents a first embodiment of the lighting system and the righthand half of the drawing presents a second embodiment of the lighting system.

The escalator/moving walkway illustrated in FIGS. 1 and 2 connects a first plane E1 with a second plane E2. The escalator 1 comprises two stationary, lateral balustrades 2. Each of the balustrades has an inner panelling 3, here slightly inclined, and a vertical outer panelling 12. The inner panelling 3 is formed substantially by light-permeable plates 3.1, in the present example consisting of a safety laminated glass. Since the plates 3.1 do not have any interruptions for mounting of lighting bodies or the passage of light, they are rigid even with a relatively small wall thickness. In covered regions, these plates 3.1 can have passages or break-outs, which can be used for, in particular, fastening thereof.

The term "interruption-free plates 3.1" as is used in the sense of the invention to reference a plate which, in the region visible after installation, does not have any interruptions for the mounting of lighting bodies or the passage of light. An interruption-free plate 3.1 can very well have passages or break-outs in covered regions, as already explained.

A handrail 4, which moves in the movement direction of the escalator 1 when the escalator is running, is disposed above each of the balustrades 2. A step belt 5 is arranged at the bottom between the balustrades 2 and moves together with the handrail 4. In its center region between the planes E1 and E2 the step belt in the escalator 5 forms stair steps, whereas in the region of the run-out zones at the level of the planes E1 and E2 it adopts the form of a tread belt as used throughout the run of the moving walkway. The handrail 4 and the step belt 5 are preferably closed, endless elements.

One or more lighting bodies 6 are arranged in the interior of each balustrade 5, i.e. in a space which is laterally bounded by the inner panelling 3 and the outer panelling 12. FIG. 2 shows at the left a first illustrative embodiment in which a lighting body 6 or a plurality of lighting bodies 6 are provided, but all at the same spacing in height above the step belt 5. FIG. 2 shows at the rightside a second illustrative embodiment with several lighting bodies 6 which are arranged at two different levels in order to better illuminate the step belt 5.

The lighting bodies 6 can be mounted in any desired number and arrangement, it merely being essential that lighting of the inner panelling 3 over the whole area is achieved. In order to obtain a very uniform lighting of the inner panelling 3 it is advantageous to provide many lighting bodies with low power rather than a few lighting bodies 6 with high power. This is also to be preferred because in the case of arrangement of a multiplicity of lighting bodies the failure of an individual lighting body is much less noticeable to the users.

By lighting of the inner panelling 3 over the whole area there is to be understood in connection with the present invention a very uniform illumination/lighting of the region of the inner panelling 3 which is visible, in the mounted state, for the users of the moving walkway or escalator installation. In that case, no ribs or separating webs between lit areas are visible, so that an uninterrupted, homogeneous lit area is created. In addition, the outlines of lighting bodies are not visible. This yields an aesthetic effect not previously represented.

An improvement in the lighting can be achieved in that reflectors 7 are installed for the lighting bodies 6 or at least some of the lighting bodies 6. Various favourable arrangements of the reflectors 7 are apparent from FIG. 2. The reflectors 7 are preferably so designed and arranged in relation to the lighting bodies 6 that at least a portion of the light emanating from the lighting bodies 6 is reflected in the direction of the inner panelling 3. In a further, preferred form of embodiment the reflectors 7 are so designed and arranged with respect to the lighting bodies 6 that the reflected light and the light which is emitted directly by the lighting bodies 6 in the direction of the inner panelling 3 are superimposed in the region of the inner panelling 3 in order to thereby achieve a uniform illumination.

Figure 3:
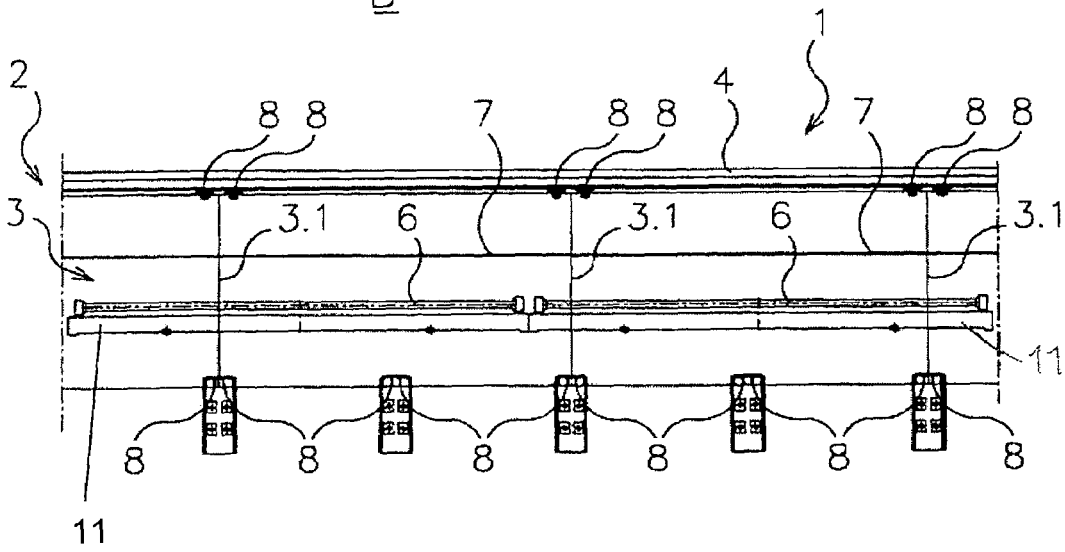
FIG. 3 shows the region, which is denoted by B in FIG. 1, of the escalator, but with a horizontal arrangement of the step belt in a scale enlarged relative to FIG. 1.

In FIGS. 2 and 3 it is illustrated how the inner panelling 3 or the plates 3.1 can be fastened. Since these plates 3.1 should be exchangeable, they are tightened against abutments with the help of inner panelling springs 8. The abutments lie substantially in the area of the inner panelling 3 and comprise, in the present example of embodiment, a lower abutment disposed in stationary position in the region of the step belt 5 and an upper abutment disposed in stationary position in the vicinity of the handrail 4.

The lighting bodies 6 are arranged in corresponding sockets 11. The sockets 11 and, in a given case, the reflectors 7 are fastened to a mechanical structure in the interior of the balustrade 2. The sockets 11 are for this purpose fastened by way of intermediate elements 9, in the present example of embodiment by way of mounting elements with a triangular cross-section or by way of longitudinal beams, to balustrade uprights 10 which are additionally used as a mechanical structure for fastening of the lighting bodies 6 inclusive of the reflectors 7. The mounting elements or longitudinal beams can be arranged mechanically at or between the balustrade uprights 10.

In a further advantageous form of embodiment a mechanical structure may be provided within the balustrade 2, which for this purpose is designed to carry the lighting bodies 6 together with the corresponding sockets 11 and the optional reflectors 7.

We claim:

1. A lighting system for a moving walkway or escalator installation which comprises a plate belt or step belt and a balustrade, the balustrade comprising first and second balustrade units located on opposite sides of the moving walkway or escalator each constructed of spaced inner and outer paneling bounding a balustrade unit interior, the lighting system comprising a light-permeable inner paneling of the balustrade unit formed by one or more mutually adjoining plates free of interruption, and one or more lighting bodies arranged in corresponding sockets fastened in the interior of the balustrade unit to a mechanical structure whereby the inner paneling can be lit up over a whole area.

2. The lighting system according to claim 1, characterized in that the sockets of the lighting bodies are mechanically fastened to balustrade uprights.

3. The lighting system of claim 2, wherein the sockets are mechanically fastened by at least one of intermediate elements or longitudinal beams.

4. The lighting system according to claim 1 or 2, characterized in that the plates of the light-permeable inner paneling are made of laminated safety glass.

5. The lighting system according to claim 1 or 2, characterized in that the light-permeable inner paneling is at least one of opal glass, color-tinted, or having a structured outer surface.

6. The lighting system according to claim 1 or 2, characterized in that the plates of the light-permeable inner paneling have a surface facing the lighting bodies with a coating of a fluorescing or phosphorescing material.

7. The lighting system according to claim claim 1 or 2, characterized in that the lighting bodies are selected from the group consisting of neon tubes, power-saving lamps, incandescent lamps, fluorescing bodies and phosphorescing bodies.

8. The lighting system of claim 7 wherein the lighting bodies are constructed for emission of color-toned light.

9. The lighting system according to claim 1 or 2, characterized in that the lighting bodies have reflectors.

10. A moving walkway or escalator installation having a plate belt or step belt, a balustrade comprising first and second balustrade units each having inner and outer paneling positioned along opposed sides of the moving walkway or escalator and a lighting system comprising a light-permeable inner paneling of at least one of the balustrade units and one or more lighting bodies, wherein the inner paneling is formed by one or more mutually adjoining plates free of interruption, the lighting bodies being arranged in corresponding sockets fastened to a mechanical structure in an interior of the at least one balustrade unit having the light-permeable inner paneling between the inner and outer paneling whereby the inner paneling is illuminated over a whole area.

11. The moving walkway or escalator installation according to claim 10, characterized in that the mechanical structure comprises balustrade uprights and at least one of intermediate elements, mounting brackets, and longitudinal beams.

* * * * *